United States Patent [19]

Tupper

[11] Patent Number: 4,560,098

[45] Date of Patent: Dec. 24, 1985

[54] THREADING DEVICE

[75] Inventor: Alan W. Tupper, Castle Combe, England

[73] Assignee: Latchways Limited, London, England

[21] Appl. No.: 542,357

[22] Filed: Oct. 17, 1983

[30] Foreign Application Priority Data

Nov. 9, 1982 [GB] United Kingdom ..... 8231930
Feb. 3, 1983 [GB] United Kingdom ..... 8303016

[51] Int. Cl.[4] ..... B63B 21/04; B63B 21/54
[52] U.S. Cl. ..... 226/92; 114/230
[58] Field of Search ..... 114/230, 221 R; 104/182; 226/92; 294/19.1

[56] References Cited

U.S. PATENT DOCUMENTS

| | | | |
|---|---|---|---|
| 219,153 | 9/1879 | Frazee | 114/221 R |
| 506,037 | 10/1893 | Forbes | 104/182 |
| 1,429,007 | 9/1922 | Wilson | 104/182 |
| 2,347,718 | 5/1944 | Terry | 114/230 X |
| 2,529,271 | 11/1950 | Winter | 114/230 X |

*Primary Examiner*—Harvey C. Hornsby
*Assistant Examiner*—Scott J. Haugland
*Attorney, Agent, or Firm*—Scully, Scott, Murphy & Presser

[57] ABSTRACT

A device for threading a line with, or through, an annular member, or other endless or apertured member, from a remote position, comprises a body for location at the end of a pole, a rotor having a recess therein, and a threading member to which a line is connected. The rotor comprises a pair of spaced discs having arcuate recesses on their facing surfaces which engage corresponding arcuate flanges on the body and threading member to allow the rotor to rotate with respect thereto. The rotor is biassed to maintain the recess therein open to a space between a threading portion of the threading member and a confronting portion of the body to receive a ring or other similar element in which the threading portion is engaged. On further movement, the rotor rotates relative to the threading member to allow the ring to pass onto a line attached to the threading member.

15 Claims, 12 Drawing Figures

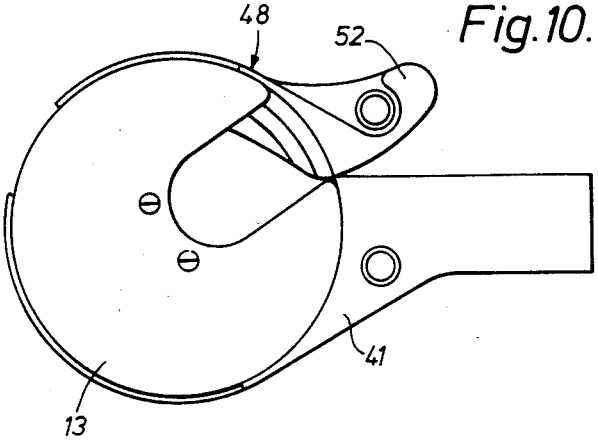
Fig.10.
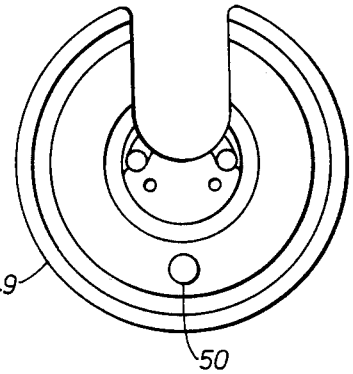
Fig.11.
Fig.12.
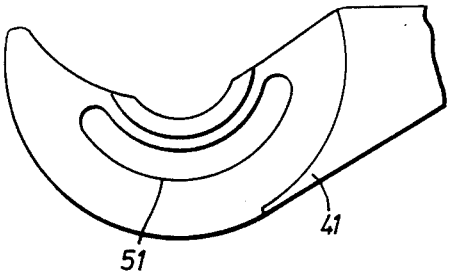

THREADING DEVICE

FIELD AND BACKGROUND OF THE INVENTION

The invention relates to a device for threading a line or other elongate element with, or through, at least one annular member or other endless or apertured member. Such a device can be applied to any remote threading operations, e.g. threading a mooring line of a boat through a fastening ring mounted on a buoy or at a fixed position on shore, and to a variety of other similar threading operations. In addition to the threading operation, it follows that by holding or securing the free end of the threaded line a remote grappling or attaching operation becomes available. Another possible application is recovery of a person or object by passing a line around him or it and threading the line through a ring incorporated therein to form a loop around the person or object.

U.S. Pat. No. 2,540,868 (Ehrhart) discloses an intermediate wire suspension for passing a moving load particularly for the transportation of logs. The device includes a biassed rotor having slots to pass a log suspension element. However Ehrhard's device is adapted for suspension from an overhead structure by a hook (12) in order to support the log transport cable (1) so that it is quite unsuitable for threading operations with which the present invention is concerned.

SUMMARY OF THE INVENTION

The invention provides a threading device comprising a body part, a rotor part comprising at least one wheel having a recess in its periphery, the wheel being rotatably mounted on the body part with a portion thereof protruding from the body part, and a threading member cooperating with said protruding portion of the wheel and having an elongate threading portion extending in the general plane of the wheel to one side of the wheel for engagement with an annular, endless or apertured element to be threaded, the threading member and the wheel having arcuate interengaging means which permit rotation of the wheel relative to the threading member when a portion of said element is received, in use, in the recess in the wheel to allow said threading member to pass through said element to be threaded, and means for biassing the wheel to a position in which said recess is in general alignment with a space which is defined, during use of the device, between said threading portion of the threading member and an opposing portion of said body part.

In some constructions according to the invention the threading member may have a line attachment portion extending generally to the opposite side of the wheel to the threading portion thereof for attachment thereto of a line or other elongate member to be threaded through, or with, said element.

In other constructions according to the invention means may be provided on said threading portion for the attachment thereto of a line or other flexible elongate member. In such constructions said element may be incorporated in said line or other member intermediate its length so that the line or member can be passed around a person or object and the threading member then passed through said element enabling a loop to be formed around the person or object from a remote position.

Said rotor part may comprise two spaced apart wheels each having a peripheral recess, the recesses of the wheel being in alignment with one another, wherein the threading member and the body part extend between the wheels. In other possible embodiments the rotor part may comprise a single wheel, with the threading member and body part being fabricated to embrace respective peripheral portions of the wheel.

Said interengaging means may comprise at least one arcuate recess in the, or each, wheel and at least one corresponding arcuate projection provided on the threading member to engage with the, or a respective, recess in the wheel; or vice versa.

The rotor part may be mounted on the body part by at least one arcuate recess in the, or each, wheel and at least one corresponding arcuate projection provided on the body part to engage with the, or a respective, recess in a wheel; or vice versa. The arcuate recesses in the rotor part may be set eccentrically so as to provide increased leverage during the passage of a member through the device. This eccentric feature also varies the gap available between the body part and the threader part.

In other embodiments, the rotor part may be mounted on the body part for rotary movement relative thereto by an axle which is eccentrically disposed with respect to the rotor part such as to provide an increased leverage during the passage of a member through the device as compared to an arrangement in which the rotor part rotates about a symmetrically positioned axis.

The rotor part may comprise a circular disc part formed with said recess in its periphery, or a pair of such discs.

Said biassing means may comprise an elongate elastic member connected between the body part and the rotor part so as to rotate the rotor part in one direction towards said position thereof. Interengageable stop means may be provided on the body part and the rotor part to arrest the rotor part in said position thereof when returned to such position under the influence of said biassing means. An alternative means of biassing may be provided by an elongate elastic member attached at one end by a movable pin which would hold the rotor to one position or another.

The threading device may be in the form of an end fitting for mounting at one end of an elongate handle, such as a wooden or metal rod or pole.

The various parts of a threading device according to the invention may be fabricated from sheet metal or moulded of plastics material.

BRIEF DESCRIPTION OF THE DRAWINGS

FIGS. 10–12 are, respectively, a side view of a further embodiment, a side view of a disc element of the rotor part of that embodiment and a side view of a portion of the body part thereof.

DETAILED DESCRIPTION OF THE EMBODIMENTS

Figure 1:
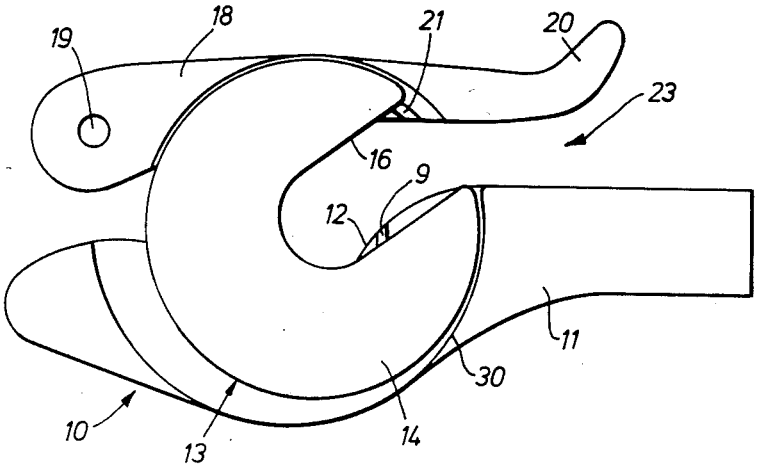
FIG. 1 is a side view of a threading device embodying the invention showing the rotor thereof in an initial position.
Figure 2:
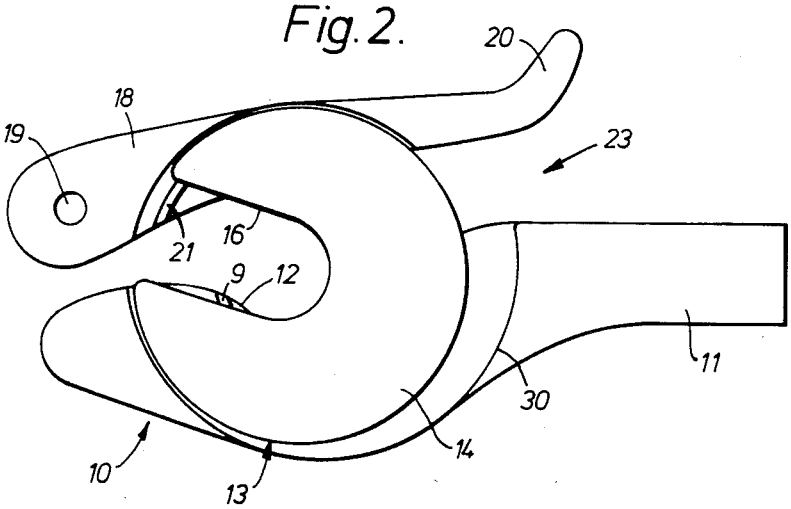
FIG. 2 is a side view of the device of FIG. 1 showing the rotor in a second position.
Figure 3:
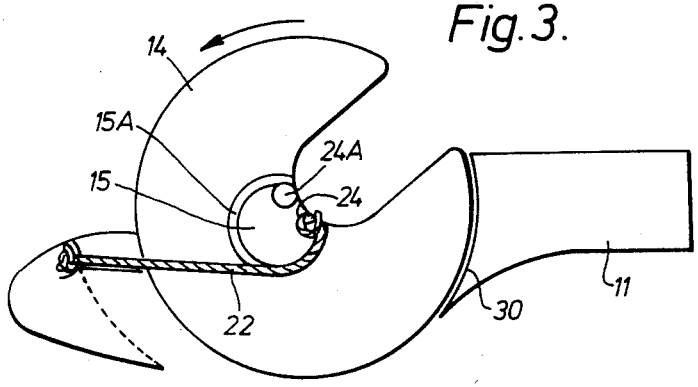
FIG. 3 is a detail of the device of FIGS. 1 and 2 showing means for biassing the rotor to its initial position.
Figure 4:
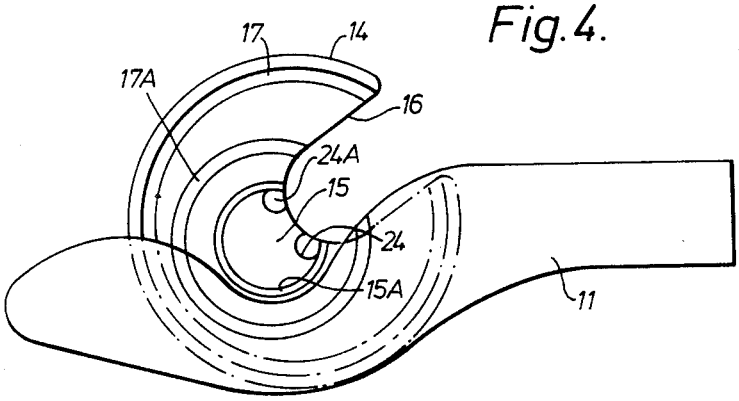
FIG. 4 is a vertical section through the body part of the device of FIG. 1 illustrating one form of eccentric mounting of the rotor thereon.

Referring to FIGS. 1 to 4 and FIG. 8 of the drawings, there is shown a threading device (10) embodying the invention, in the form of an end fitting for mounting at an end of an elongate handle, for example a wooden rod. The device comprises a hollow body part (11) having a tubular shank for location at one end of a wooden rod. The body part (11) has a depression (12) formed in its upper surface to receive an axle section of a rotary part (13) of the device as described below.

The rotary part (13) of the device comprises a pair of spaced circular discs (14) having integrally formed boss portions (15) which project from the discs and are eccentrically positioned with respect to the peripheries of the discs, the boss portions being secured together to form a hub of the rotor part (13). This hub is received in the above-mentioned depression (12) in the body part (11). Each disc (14) of the rotor part is formed with a peripheral recess (16), the recesses in the two discs (14) being in alignment with one another. Each disc (14) is further formed with an arcuate groove (17) which is spaced inwardly of, and is concentric with, the outer periphery of the disc extending between the opposed side walls of the slot (16) and with a second inner arcuate groove (17A) which is concentric with the hub of the rotor and therefore eccentric with respect to the periphery of the disc and with respect to the outer arcuate groove (17). The grooves (17,17A) in the discs (14) are formed in their confronting surfaces. The body part (11) is formed on its opposite side surfaces with arcuate projecting ridges (9) which conform to and engage in the grooves (17A) in the discs (14) so as to locate the rotor member (13) on the body part (11) while allowing rotation thereof with respect to the body part.

The device further comprises a threading member (18) having at one end thereof an eyelet (19) or other attachment means for the attachment thereto of a rope and at the other end thereof an upturned threading portion (20) which, towards its end, extends progressively away from the main body part (11) of the device to faciitate engagement thereof in a ring or other member through which or around which a rope attached to the threading member (18) is to be threaded. A pair of arcuate projections (21) are provided on opposite side faces of the threading member (18) at a central portion thereof for engagement in the recesses (17) of the pair of disc members (14), respectively. In this way the threading member (18) is located with respect to the rotor member (13) while allowing rotation of the rotor member with respect to the threading member.

An elastic cord (22) is provided for aligning the recesses (16) of the discs (14) with the entry slot (23) defined between the threading portion (20) of the threading member (18) and the opposed portion of the body part (11) so that a ring or other member which is engaged in the entry slot (23) in use can engage in the recesses (16) during a threading operation. The cord (22) is secured at one end within the hollow nose portion of the body part (11). The cord then extends into the depression (12) formed in the body part and is wrapped part way around the hub (15) of the rotor part (13). The cord is located in a ledge (15A) which extends part way around the hub (15). The other end of the cord is attached to a fixing (24) provided on the rotor part (13) at an end of the ledge (15A) and acts to rotate the rotor part in a clockwise direction as viewed in FIGS. 1 and 2 in order to align the recesses (16) in the rotor part with the entry passage (23) as illustrated in FIG. 1. Arcuate abutment surfaces (30) project laterally of the body part (11) in order to positively locate the rotor part in this position.

In operation, the threading device (20), which is fixed to the end of a wooden rod or pole, can be manipulated from a remote location so that it is positioned beyond a ring or a rung stock of a ladder on a dockside wall or through the T-bar of a double staghorn bollard to be threaded with a line attached to the eyelet (19) of the threading member. The threading device is then moved backwards in order to engage the ring or rung in the entry passage (23) between the threading member and the body part (11) of the device. On further backward movement of the threading device the ring or rung becomes engaged in the recesses (16) which are at the time being held in alignment with the entry passage (23) by the action of the elastic cord (22). On further backward movement the ring or rung passes through the treading device by causing the rotor part (13) to rotate in an anti-clockwise direction against the action of the elastic cord (22) to the position illustrated in FIG. 2 and thence onto a rope or other line attached to the eyelet (19) to complete the threading operation. By holding or securing the free end of the threaded rope or line, a remote grappling or attaching operation can be performed.

It will be appreciated that the eccentric mounting of the rotor on the body part provides increasing leverage during passage of the ring or rung stock through the device since it acts to rotate the rotor member at increasing greater distances from the axis of the hub. A variation takes place, during such passage, in the distance between the threading member (18) and the body part (11).

The device as shown in FIG. 1 is particularly suitable for threading a line through rings provided on buoys where a backward threading action is preferable. However in other applications where a ring or rung stock is rigidly mounted, for example in some mountaineering applications, it may be advantageous to carry out the threading operation in a forward direction. In such cases the threading member (21) is assembled in the opposite direction to that shown in FIG. 1 so that the threading portion (20) thereof is adjacent the nose portion of the body part (11), and the elastic cord (22) is connected to the shank portion of the body part (11) to cooperate with a fixing (24A) provided on the rotor part (13) whereby the rotor member is biassed in an anti-clockwise direction by the cord (22). A second arcuate abutment (30A) is provided to act as an end stop for the rotor part.

It will be appreciated that, although in the above described embodiment, arcuate projections or ridges are provided on the body part (11) and the threading member (18) with grooves being provided in the discs (14) of the rotor part, it would be possible in other embodiments to provide arcuate grooves in the body part (11) and in the threading member (18) with cooperating arcuate projections being formed on the disc members (14) of the rotor part (13).

Figure 5:
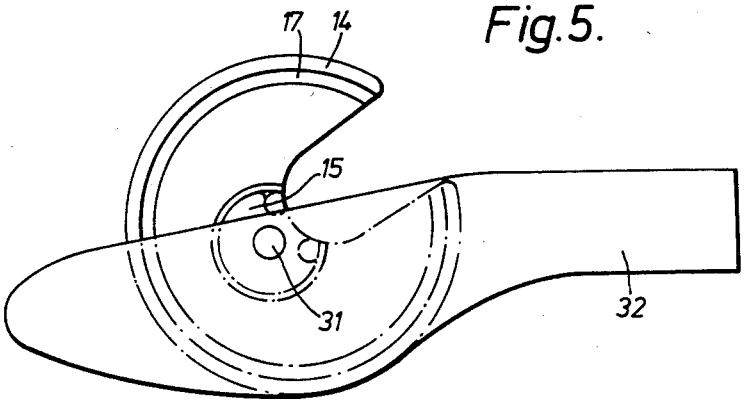
FIG. 5 is a vertical section through the body part of the device of FIG. 1 illustrating another form of eccentric mounting of the rotor thereon.

FIG. 5 shows a second embodiment of a threading device which is similar to that shown in FIG. 1 with the principal exception that the rotor member (13) is located with respect to the body part (11) by an axle (31) which passes centrally through the eccentric hub (15) of the rotor part, and is received in an aperture in the body part (32), instead of by the provision of arcuate projections on the body part which engage in grooves (17A) provided in the disc members (14), as in the FIG. 1 embodiment.

Figure 6:
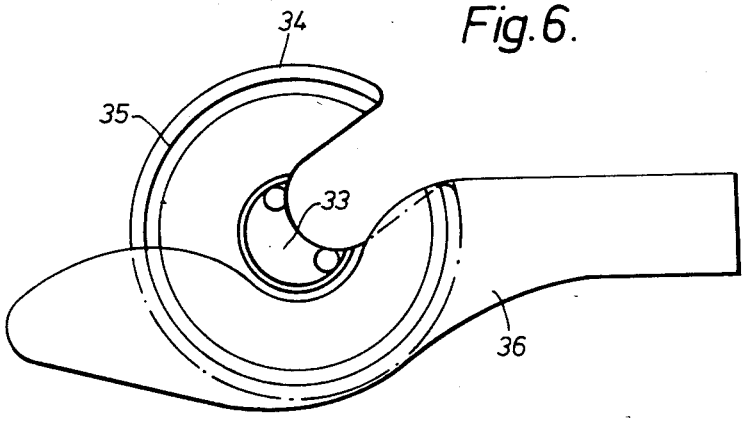
FIG. 6 is a vertical section through the body part of the device of FIG. 1 illustrating one form of concentric mounting of the rotor thereon.
Figure 7:
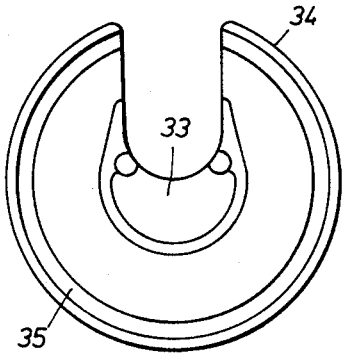
FIG. 7 is a side view of an element of a rotor of a device according to the invention for the concentric mounting arrangement of FIG. 6.
Figure 8:
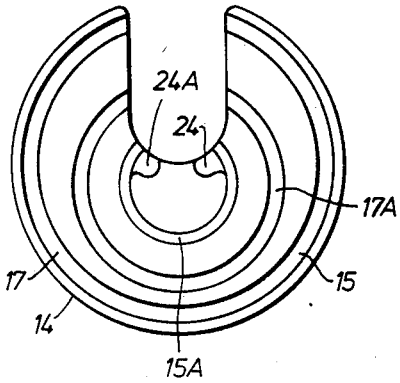
FIG. 8 is a side view of a rotor for the eccentric mounting arrangement of FIG. 5.

FIGS. 6 and 7 show a third embodiment which differs from the embodiment in FIG. 1 in that the hub (33) is concentrically disposed with respect to the periphery of the respective rotor disc (34) and in that each disc (34) has a single arcuate groove (35) concentric with, and disposed adjacent to, the periphery of the disc, with arcuate ridges or projections of the same curvature being provided on both the threading member and the body part (36) for engagement in the grooves (35) in the rotor discs. This concentric mounting arrangement of the rotor therefore does not provide the increasing leverage of the eccentric mounting arrangement, which may not be necessary for some applications.

Figure 9:
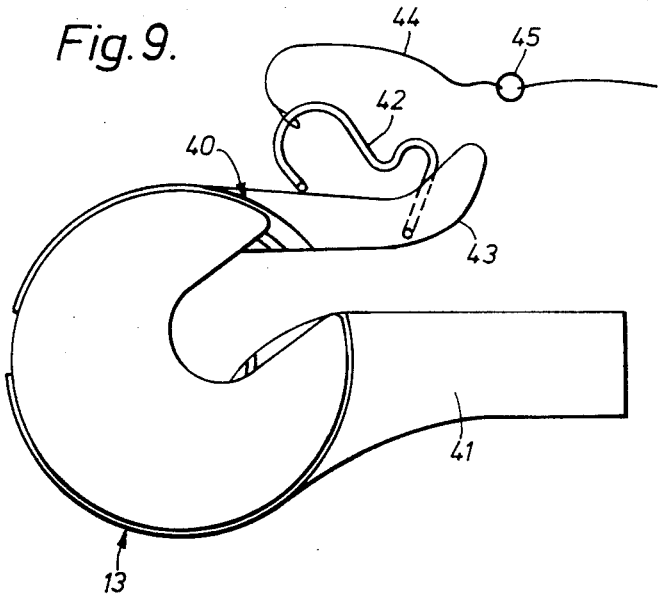
FIG. 9 is a side view of a further embodiment which is particularly suitable for forming a loop of line around an object from a remote position.

FIG. 9 illustrates a further embodiment which is particularly suitable for recovery of persons or objects by forming a loop of line around the person or object from a remote position. The construction is generally similar to that shown in FIG. 1 except that the threading device (40) and body part (41) extend to one side only of the rotor part (13). The biassing cord for the rotor part will act in a similar fashion to that shown in FIG. 3 but it will be attached at one end in the shortened body part (41). A resilient clip (42) is provided on the threading portion (43) of the threading device (40) for attaching one end of a rope or other line (44) thereto. A ring (45) is incorporated in the rope or line intermediate its length. A person, or object, can be recovered, e.g. from the sea, by passing the threading device shown in FIG. 9, which is mounted on the end of a rod or pole, together with the rope attached thereto around the person or object and then threading the threading device (40) through the ring (45) to form a loop of rope around the person or object to facilitate recovery thereof. Various different means may be employed for attaching an end of the rope (44) to the threading device (40), an example being a piece of elastic which has a ball at the end and is associated with the rope, the elastic being wrapped around the threading device to anchor via the ball in a recess in the threading portion (43). FIGS. 10 to 12 illustrate such a device, having a similar rotor part (13) provided by two similar disc elements (49) as shown in FIG. 11; and a similar shortened body part (41) as illustrated in FIG. 12. It will be seen that the movement of the rotor part (13) is limited by pegs (50) on the disc elements (49) which engage in arcuate recesses (51) on the body part (41). The threading device (48) has a shorter threading portion (52) than that of the FIG. 9 embodiment.

I claim:

1. A threading device comprising a body part;

a rotor part comprising a hub and at least one wheel having a recess in its periphery, the wheel being rotatably mounted on the body part with a portion of the wheel protruding from the body part;

a threading member cooperating with said protruding portion of the wheel and having an elongate threading portion extending in the general plane of the wheel to one side of the wheel for engagement with an annular, endless or apertured element to be threaded, the threading member and the wheel having arcuate interengaging means to permit rotation of the wheel relative to the threading member and to allow said threading member to pass through said element to be threaded, said wheel having an initial position, in which said recess is in general alignment with a space which is defined, during use of the device, between said threading portion of the threading member and an opposing portion of said body part; and further comprising means automatically returning the wheel to the initial position after a displacement therefrom in which said element to be threaded passes through the wheel; said returning means comprising (i) an elongate elastic member having a first end secured to the body, extending around the hub of the rotor, and having a second end engaging the rotor and urging the rotor to said initial position, and (ii) means to hold the rotor in said initial position.

2. A device as claimed in claim 1 wherein the threading member has a line attachment portion extending generally to the opposite side of the wheel to the threading portion thereof for attachment thereto of a line or other elongate member to be threaded through, or with, said element.

3. A device as claimed in claim 1 wherein means are provided on said threading portion for the attachment thereto of a line or other flexible elongate member.

4. A device as claimed in claim 1, wherein said rotor part comprises two spaced apart wheels each having a peripheral recess, the recesses of the wheels being in alignment with one another, wherein the threading member and the body part extend between the wheels.

5. A device as claimed in claim 1, wherein the rotor part comprises a single wheel, with the threading member and body part being fabricated to embrace respective peripheral portions of the wheel.

6. A device as claimed in claim 1, wherein said interengaging means comprise at least one arcuate recess in the, or each, wheel and at least one corresponding arcuate projection provided on the threading member to engage with the, or a respective, arcuate recess in the wheel; or vice versa.

7. A device as claimed in claim 6, wherein the threading member and the body part are located with respect to the rotor part by the same arcuate recesses and cooperating projections.

8. A device as claimed in claim 1, wherein the rotor part is mounted on the body part by at least one arcuate recess in the, or each, wheel and at least one corresponding arcuate projection provided on the body part to engage with the, or a respective, arcuate recess in a wheel; or vice versa.

9. A device as claimed in claim 8 wherein arcuate recesses are provided in the rotor part and are set eccentrically with respect thereto so as to provide increased leverage during the passage of a member through the device.

10. A device as claimed in claim 1, wherein the rotor part is mounted on the body part for rotary movement relative thereto by an axle which is eccentrically disposed with respect to the rotor part such as to provide an increased leverage during the passage of a member through the device as compared to an arrangement in which the rotor part rotates about a symmetrically positioned axis.

11. A device as claimed in claim 1, wherein the wheel comprises a circular disc with said recess being formed in the periphery of the disc.

12. A device as claimed in claim 1, wherein said elongate elastic member is attached at one end by a movable pin.

13. A device as claimed in claim 1 wherein said stop means comprise an abutment surface of the body part for engagement by the periphery of the rotor part.

14. A device as claimed in claim 1, wherein said stop means comprise an arcuate recess in the body part and a pin in the rotor part engaging in that recess.

15. A device as claimed in claim 1, wherein the threading device is in the form of an end fitting for mounting at one end of an elongate handle.

* * * * *